US007216856B2

(12) United States Patent
Iwasa et al.

(10) Patent No.: US 7,216,856 B2
(45) Date of Patent: May 15, 2007

(54) ACCELERATOR APPARATUS FOR DIAPHRAGM CARBURETOR

(75) Inventors: Yoshiharu Iwasa, Iwate-ken (JP); Mamoru Toda, Iwate-ken (JP)

(73) Assignee: ZAMA Japan Co., Ltd., Iwate-Gun, Iwate-ken (JP)

( * ) Notice: Subject to any disclaimer, the term of this patent is extended or adjusted under 35 U.S.C. 154(b) by 0 days.

(21) Appl. No.: 11/229,722

(22) Filed: Sep. 20, 2005

(65) Prior Publication Data

US 2007/0063357 A1 Mar. 22, 2007

(51) Int. Cl.
*F02M 7/08* (2006.01)

(52) U.S. Cl. ..... 261/34.2; 123/437; 261/35

(58) Field of Classification Search ..... 261/34.2, 261/35; 123/437, 344
See application file for complete search history.

(56) References Cited

U.S. PATENT DOCUMENTS

| | | | | | |
|---|---|---|---|---|---|
| 2,551,719 | A * | 5/1951 | Ball | 261/34.2 |
| 2,660,417 | A * | 11/1953 | Anderson | 261/34.2 |
| 2,768,818 | A * | 10/1956 | Egerer | 261/23.2 |
| 2,775,435 | A * | 12/1956 | Kommer | 261/34.2 |
| 3,017,167 | A * | 1/1962 | Griffen | 261/34.2 |
| 3,404,872 | A * | 10/1968 | Nutten | 261/34.2 |
| 4,076,770 | A * | 2/1978 | Saito et al. | 261/34.2 |
| 4,088,102 | A * | 5/1978 | Kato | 123/437 |
| 4,179,245 | A * | 12/1979 | Fuller | 417/292 |
| 5,843,345 | A * | 12/1998 | Guntly | 261/34.2 |
| 6,293,524 | B1 * | 9/2001 | Endo et al. | 261/34.2 |
| 6,595,500 | B2 * | 7/2003 | Osburg et al. | 261/34.2 |
| 6,676,114 | B2 * | 1/2004 | Gerhardy | 261/34.2 |
| 6,938,884 | B2 * | 9/2005 | Knaus et al. | 261/34.2 |
| 2002/0163087 | A1 * | 11/2002 | Gerhardy | 261/34.2 |
| 2004/0130040 | A1 * | 7/2004 | Araki | 261/34.2 |

FOREIGN PATENT DOCUMENTS

| | | | |
|---|---|---|---|
| JP | 52-43026 | * 4/1977 | 261/34.2 |
| JP | 60-195365 | * 10/1985 | 123/344 |

* cited by examiner

*Primary Examiner*—Richard L. Chiesa
(74) *Attorney, Agent, or Firm*—Baker Botts L.L.P.

(57) ABSTRACT

The accelerator apparatus prevents air from remaining within a pump chamber and discharged fuel vapor from causing a pumping effect so as to a destabilize engine operation and increase of an exhaust gas content of harmful material, in an accelerator apparatus in which an accelerated fuel passage draws and discharges fuel to the pump chamber of an accelerator pump, which is connected to a main fuel passage. The pump chamber of the accelerator pump is mechanically coupled with a throttle valve and is connected to a fixed fuel chamber storing a fuel delivered to an intake passage at a fixed pressure by the accelerated fuel passage. Air remaining within the pump chamber and a fuel vapor generated within the pump chamber are discharged to the fixed fuel chamber, and fuel extruded from the pump chamber due to a pumping effect of the remaining air and the fuel vapor enters into the fixed fuel chamber, thereby preventing the alteration of a rate of the fuel flowing through a main fuel passage. Fuel in the pump chamber is fed to the fixed fuel chamber during acceleration so as to increase a pressure in the fixed fuel chamber, and an accelerated fuel is obtained by increasing the amount of the delivered fuel to the intake passage.

14 Claims, 4 Drawing Sheets

ACCELERATOR APPARATUS FOR DIAPHRAGM CARBURETOR

BACKGROUND OF THE INVENTION

1. Field of the Invention

The present invention relates to accelerator apparatus provided in diaphragm carburetors for supplying fuel to compact, general purpose engines.

2. Description of Related Art

It is known that an accelerator apparatus having an accelerator pump mechanically coupled to a throttle valve may be provided as a means for increasing a rate of fuel flow delivered to an intake passage of a carburetor in response to an increased amount of air intake, during accelerated operation of an engine.

In known diaphragm carburetors, as depicted in conceptual diagrams in FIGS. 2A, 2B, and 2C, in which fuel delivered from a fuel tank by a fuel pump is held in a fixed fuel chamber at a fixed pressure by utilizing a diaphragm and an atmospheric pressure. Such fuel then is delivered to an intake passage from the fixed fuel chamber and supplied to an engine.

Referring to the structure shown in FIG. 2A, which is described, for example, in Japanese Unexamined Patent Publication No. 60-195365, the disclosure of which is incorporated herein by reference; a main jet 54 defining a maximum rate of fuel flow and a regulating needle valve 55 regulating a rate of fuel flow are disposed in a main fuel passage 53 extending from a fixed fuel chamber 51 to a main nozzle port 52. Further, a pump chamber 58 of an accelerator pump 57 is connected to main fuel passage 53 downstream of regulating needle valve 55 by a single accelerated fuel passage 59. Further, referring to the structure shown in FIG. 2B, which is described, for example, in Japanese Unexamined Patent Publication No. 10-238411, the disclosure of which is incorporated herein by reference; a check valve 56, which prevents air from flowing into main jet 54 and fixed fuel chamber 51, and regulating needle valve 55 are disposed in main fuel passage 53. Accelerated fuel passage 59 is connected to main fuel passage 53 between main jet 54 and check valve 56. Further, referring to the structure shown in FIG. 2C, which is described, for example, in Japanese Unexamined Utility Model Publication No. 6-67842 and Japanese Unexamined Patent Publication No. 10-213013, the disclosures of which are incorporated herein by reference; check valve 56 and regulating needle valve 55 are disposed in main fuel passage 53. Accelerated fuel passage 59 is connected to main fuel passage 53 between check valve 56 and regulating needle valve 55.

Accelerator pump 57 and accelerated fuel passage 59 define an accelerator apparatus. Regardless, whether the throttle valve is a butterfly throttle valve or a rotary throttle valve, as described in each of the Japanese references mentioned above, accelerator pump 57 discharges fuel in pump chamber 58 during acceleration and is coupled mechanically to the throttle valve so as to deliver fuel to main nozzle port 52 from accelerated fuel passage 59 and main fuel passage 53, and accelerator pump 57 draws in fuel in fixed fuel chamber 51 to pump chamber 58 from main fuel passage 53 and accelerated fuel passage 59 during deceleration.

In the accelerator apparatus described above, connecting accelerated fuel passage 59 to main fuel passage 53 has been attempted to improve the carburetor's acceleration response. Nevertheless, when introducing fuel into a newly manufactured carburetor or after the carburetor has not been in use for a long period of time, it frequently occurs that air remains in pump chamber 58. Further, if fuel vapor is generated in pump chamber 58 due to engine heat which remains after the engine is shut down, such fuel vapor may accumulate within pump chamber 58 due to a positional attitude of accelerator pump 57 and a configuration of accelerated fuel passage 59. Further, air and fuel vapor are discharged little by little during engine operation so as to enter into main fuel passage 53, and disrupt the rate of fuel flow set by main jet 54 and regulating needle valve 55. In particular, in the structure shown in FIG. 2A, discharged air and fuel vapor entering main fuel passage 53 adversely affect the regulation of the rate of fuel flow of regulating needle valve 55. Similarly, in the structures shown in FIGS. 2B and 2C, discharged air and fuel vapor entering main fuel passage 53 dilutes an air-fuel mixture during discharging. Further, fuel vapor exerts a pumping effect, pushing out fuel within pump chamber 58 due to vibration of the engine during engine operation or a negative pressure pulsation of a venturi portion to which main nozzle port 52 is open. As a result, and fuel may be delivered to the intake passage irregularly so as to make an air-fuel ratio unstable.

As a result of these phenomena, undesirable results may occur. For example, engine operation may become unstable, and the content of harmful materials may be increased in the exhaust gas.

SUMMARY OF THE INVENTION

The present invention prevents an air-fuel mixture from becoming diluted or an air-fuel ratio from becoming destabilized in the known accelerator apparatus mentioned above, in which the single, accelerated fuel passage, which draws and discharges the accelerated fuel to the pump chamber of the accelerator pump, is connected to the main fuel passage from the fixed fuel chamber to the main nozzle port. An object of the present invention is to provide an accelerator apparatus which neither destabilizes engine operation nor causes an increase of a harmful material in the exhaust gas, even if air remains within a pump chamber or fuel vapor is generated.

In accordance with the present invention, a means for solving the problem mentioned above is provided by an accelerator apparatus of a diaphragm carburetor, as disclosed herein. Such an accelerator apparatus may comprise an accelerator pump mechanically coupled with a throttle valve; and a single accelerated fuel passage drawing fuel to a pump chamber and delivering fuel as an accelerated fuel. The accelerated fuel passage connects the pump chamber to a fixed fuel chamber in which the fuel is delivered to an intake passage and is stored at a fixed pressure.

The fixed fuel chamber is set at a negative pressure slightly lower than atmospheric pressure, and the fuel is delivered from an idle port, a slow port, and a main nozzle port in a butterfly-type throttle valve system and is delivered from the main nozzle port in a rotary-type throttle valve system, in correspondence to a difference from the negative pressure in the intake passage. The accelerated fuel, which the accelerator pump discharges during acceleration, is fed to the fixed fuel chamber so as to reduce the negative pressure or set a positive pressure, and increases the pressure difference from the negative pressure in the intake passage so as to increase the delivered fuel to the intake passage. In other words, the increased fuel flow corresponds to the accelerated fuel.

On the other hand, because the air and the fuel vapor within the pump chamber enters into the fixed fuel chamber although being discharged little by little, a rate of fuel flow delivered to the intake passage is not disrupted. Further, because the fuel, which is extruded from the pump chamber due to the pumping effect of the air and the fuel vapor, enters into the fixed fuel chamber, the flow rate of fuel flow delivered to the intake passage does not become irregular.

In accordance with the present invention, a deviation of the fuel flow rate and an irregular fluctuation are not generated by the air remaining in the pump chamber and the generated fuel vapor while achieving a desired, accelerated fuel supplying function. Thus, it is possible to reduce or eliminate the risk that the harmful material in the exhaust gas will increase and to stabilize the engine operation during steady operation.

Further objects, features, and advantages of the present invention will be understood from the following detailed description of preferred embodiments of the present invention with reference to the accompanying figures.

BRIEF DESCRIPTION OF THE DRAWINGS

Embodiments of the invention now are described with reference to the accompanying figures, which are given by way of example only, and are not intended to limit the present invention.

DETAILED DESCRIPTION OF PREFERRED EMBODIMENTS

Figure 1:
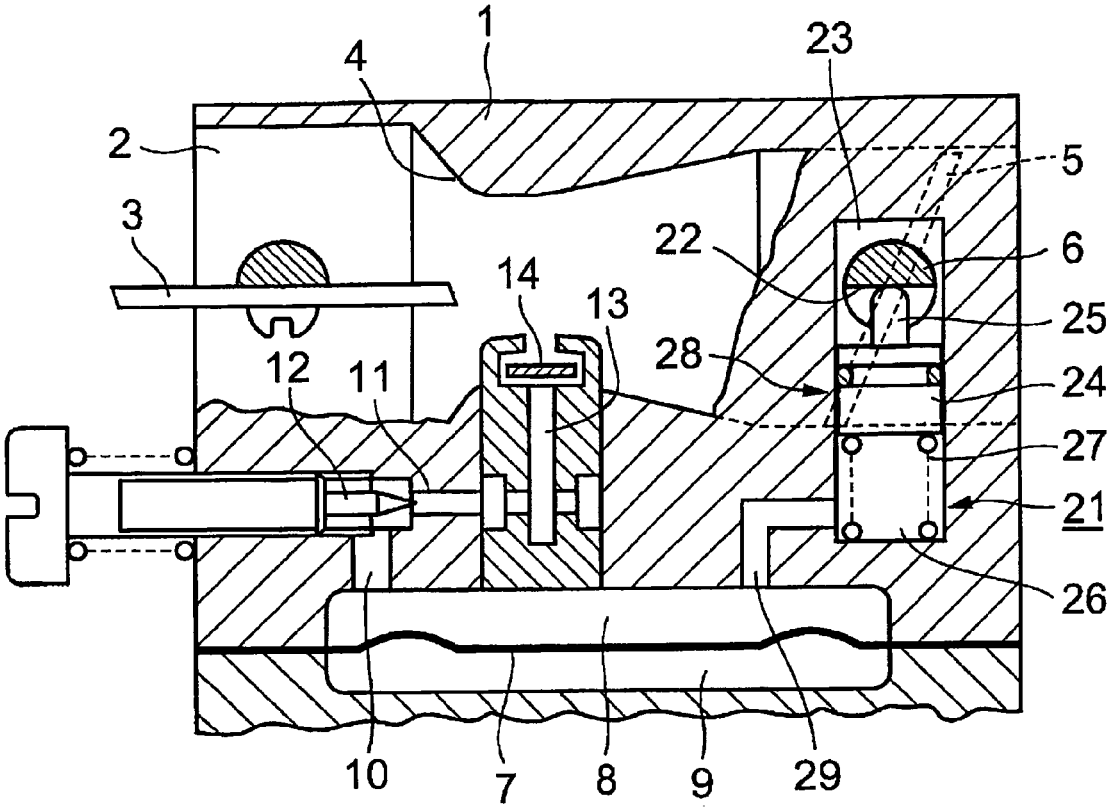
FIG. 1 is a vertical, cross-sectional view showing an embodiment in accordance with the present invention.
Figure 2A:
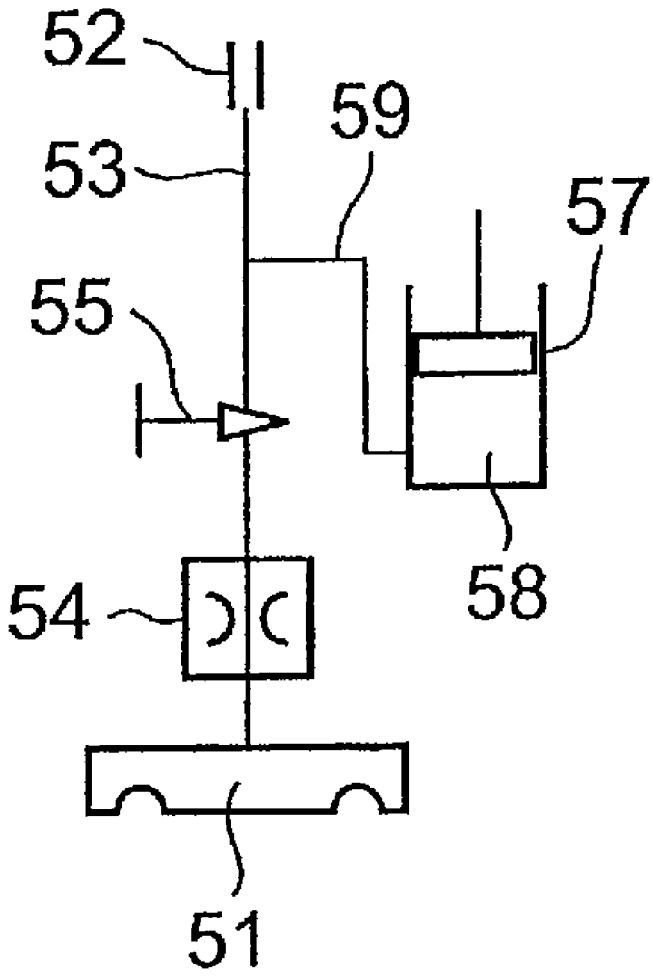
FIG. 2A PRIOR ART
FIGS. 2A, 2B, and 2C are diagrams of known diaphragm carburetors.
Figure 2B:
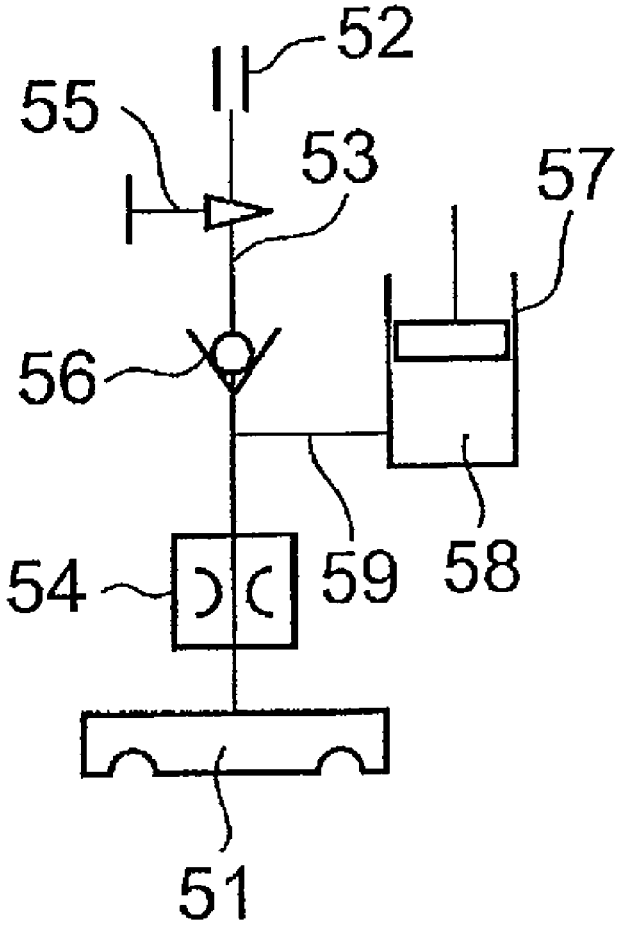
FIG. 2B PRIOR ART
Figure 2C:
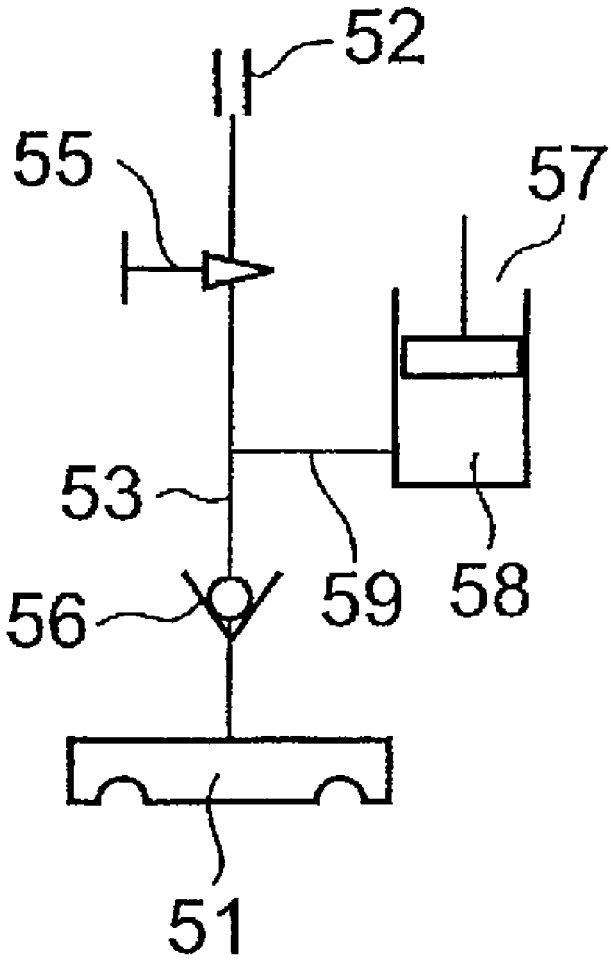
FIG. 2C PRIOR ART

A description id provided below of an embodiment in accordance with the present invention with reference to FIG. 1. A fixed fuel chamber 8 is separated from an atmospheric chamber 9 by a diaphragm 7, and fixed fuel chamber 8 is provided in a lower surface of a carburetor main body 1. Carburetor main body 1 is provided with a horizontal intake passage 2 having a choke valve 3, a venturi tube 4, and a throttle valve 5. A manual start pump and a pulsation-type fuel pump, which are not illustrated, additionally are provided in carburetor main body 1. Fuel in a fuel tank (not shown) is fed to the fixed fuel chamber 8 by the start pump or the fuel pump. Diaphragm 7 is displaced due to a difference between the pressure in fixed fuel chamber 8 and the atmospheric pressure in the atmospheric chamber 9 so as to open and close an inlet valve (not shown). Diaphragm 7 controls a fed fuel flow rate so as to cause fixed fuel chamber 8 store the fuel at a fixed negative pressure slightly lower than the atmospheric pressure.

The fuel in fixed fuel chamber 8 is delivered to a main nozzle port 13 open to venturi tube 4 through a main fuel passage 10, and is delivered to an idle port and a slow port open to intake passage 2 in a side portion of butterfly-type throttle valve 5 through a low speed fuel passage (not shown). Main fuel passage 10 has a main jet 11 defining a maximum fuel flow rate, and a manual regulating needle valve 12 inserted into main jet 11 and regulating the fuel flow rate. Main nozzle port 13 is provided with a check valve 14 which prevents air in intake passage 2 from entering into fixed fuel chamber 8.

A notch is provided in an axial end portion of a throttle valve shaft 6 attaching to throttle valve 5, and a notched surface and a hemispherical surface form a cam 22. Cam 22 is arranged in a cylinder chamber 23 formed in the carburetor main body 1 so as to be orthogonal to throttle valve shaft 6. A protruding piston rod 25 is brought into contact with a piston 24 fitted to the cylinder chamber 23. A space opposite to cam 22 with respect to piston 24 of cylinder chamber 23 forms a pump chamber 26, and a push spring 27, which urges piston rod 25 into contact with cam 22, is fitted therein. Cylinder chamber 23, piston 24, piston rod 25, pump chamber 26, and push spring 27 mentioned above constitute an accelerator pump 28.

Pump chamber 26 is connected to the fixed fuel chamber 8 by a single, accelerated fuel passage 29, and accelerator pump 28 and accelerated fuel passage 29 constitute an accelerator apparatus 21.

When throttle valve 5 is at an idle position, piston rod 25 is brought into contact with the notched surface of cam 22 so as to increase pump chamber 26 to a maximum volumetric capacity. When throttle valve 5 is opened, piston rod 25 is brought into contact with the hemispherical surface of cam 22 so as to push piston 24, thereby feeding fuel in pump chamber 26 to fixed fuel chamber 8 from accelerated fuel passage 29. Accordingly, in fixed fuel chamber 8, the negative pressure is reduced and becomes a positive pressure, and the pressure difference between the negative pressure generated in the region of throttle valve 5 of intake passage 2 and venturi tube 4 increases, so that the amount of fuel delivered from the idle port, the slow port, and main nozzle port 13 is increased. The increased fuel is supplied as accelerated fuel to the engine.

Because an amount of fuel fed to fixed fuel chamber 8 from pump chamber 26 is relatively small and because a pressure increase within fixed fuel chamber 8 is temporary, the delivery of accelerated fuel is finished quickly, and fuel immediately is returned to a predetermined negative pressure. Further, fuel in fixed fuel chamber 8 is drawn into pump chamber 26 when throttle valve 5 is closed. Nevertheless, because the negative pressure within fixed fuel chamber 8 increases so as to substantially open the inlet valve at this time, a significant amount of fuel is fed from the fuel pump, and fuel immediately is returned to the predetermined negative pressure when an increase of the volumetric capacity of pump chamber 26 is finished. In other words, in accordance with the present embodiment, it is possible not only to properly supply the accelerated fuel required during acceleration and with a good response, the amount of fuel delivered is reduced or the fuel is not delivered because the negative pressure in fixed fuel chamber 8 increases during deceleration, so that a fuel cutting effect during deceleration can be obtained. Further, because fixed fuel chamber 8 immediately is returned to the predetermined negative pressure when the acceleration and the deceleration are finished, it is possible to stably maintain engine operation thereafter.

Next, if the fuel is introduced to a newly manufactured carburetor or after the carburetor has not been used for a substantial period of time, the air frequently remains within pump chamber 26. Further, when the engine ceases operation, fuel vapor may be generated within pump chamber 26 due to engine heat. If the engine is operated in a state in which the air and the fuel vapor remain within the pump chamber 26, the air and the fuel vapor are discharged little by little so as to enter into fixed fuel chamber 8. Further, when the air and the fuel vapor create the pumping effect for extruding fuel within pump chamber 26 due to the vibration of the engine and the machine, the extruded fuel enters into fixed fuel chamber 8. Accordingly, the flow rate of fuel flow delivered to intake passages during the steady operation is not disrupted so as to dilute the air-fuel mixture, and the fuel flow rate is not altered irregularly so as to destabilize the air fuel ratio, thereby stabilizing engine operation during the steady operation and preventing the harmful material content in the exhaust gas from increasing.

Because accelerated fuel passage 29 is provided independently from main fuel passage 10, pump chamber 26 is not affected by the influence of the negative pressure pulsation of venturi tube 4.

Although embodiments of the present invention have been described in detail herein, the scope of the invention is not limited thereto. It will be appreciated by those skilled in the art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An accelerator apparatus of a diaphragm carburetor comprising:

an accelerator pump mechanically coupled with a throttle valve, said accelerator pump comprising a pump chamber from a fixed fuel chamber; and a single accelerated fuel passage through which fuel is drawn to said pump chamber and delivered as an accelerated fuel, wherein said accelerated fuel passage delivers fuel from said pump chamber to said fixed fuel chamber from which the fuel is delivered through a main fuel passage to an intake passage and in which fuel is stored at a fixed pressure.

2. The accelerator apparatus of claim 1, wherein said accelerator pump comprises:

a piston disposed within said pump chamber, and a cam, which is operatively coupled to said piston by urging means disposed in said pump chamber and on which said throttle valve is pivotally mounted.

3. A carburetor comprising said accelerator apparatus of claim 1.

4. A carburetor comprising:

an intake passage comprising a venturi tube and a throttle valve, an accelerator apparatus comprising an accelerator pump and an accelerated fuel passage, wherein said accelerator pump is mechanically coupled with said throttle valve; and wherein fuel is drawn through said accelerated fuel passage to an accelerator pump chamber from a fixed fuel chamber and wherein said accelerated fuel passage delivers fuel from said pump chamber to said fixed fuel chamber from which the fuel is delivered through a main fuel passage to said intake passage;

said main fuel passage placing said fixed fuel chamber in communication with a main fuel nozzle port, wherein said main nozzle port is connected to a first end of said venturi tube, whereby fuel is delivered to said first end of said venturi tube through said main nozzle port, and said main fuel passage further comprising a main jet and a regulating valve for controlling a rate of fuel flow through said main fuel passage.

5. The carburetor of claim 4, wherein said main fuel nozzle port further comprises a check valve for preventing air in said intake passage from entering said fixed fuel chamber.

6. The carburetor of claim 4, further comprising a choke valve disposed within said intake passage for controlling the flow of air into said first end of said venturi tube.

7. The carburetor of claim 4, wherein said throttle valve is a butterfly valve.

8. The carburetor of claim 4, wherein said regulating valve is a needle valve.

9. The carburetor of claim 4, wherein said main jet is disposed in said main fuel passage between said regulating valve and said main fuel nozzle port.

10. The carburetor of claim 4, wherein said accelerator pump comprises:

a piston disposed within said pump chamber, and a cam, which is operatively coupled to said piston by urging means disposed in said pump chamber and on which said throttle valve is pivotally mounted.

11. An internal combustion engine comprising the carburetor of claim 4.

12. A diaphragm carburetor comprising:

an accelerator pump mechanically coupled with a throttle valve, said accelerator pump comprising a pump chamber; and an accelerated fuel passage connecting said pump chamber to a fixed fuel chamber;

wherein fuel is drawn into said pump chamber from said fixed fuel chamber through said accelerated fuel passage, and said fuel is delivered from said pump chamber to said fixed fuel chamber as accelerated fuel through said accelerated fuel passage.

13. The diaphragm carburetor of claim 12, further comprising a main fuel passage connected to said fixed fuel chamber, said main fuel passage in communication with a main nozzle port.

14. The diaphragm carburetor of claim 13, further comprising a main jet and a regulating valve disposed in said main fuel passage.

* * * * *